US007909278B2

(12) United States Patent
Yamada

(10) Patent No.: US 7,909,278 B2
(45) Date of Patent: Mar. 22, 2011

(54) AUTO VEHICLE CAPABLE OF PROCESSING WASTE MATTER

(76) Inventor: Susumu Yamada, Maibara (JP)

( * ) Notice: Subject to any disclaimer, the term of this patent is extended or adjusted under 35 U.S.C. 154(b) by 204 days.

(21) Appl. No.: 12/198,294

(22) Filed: Aug. 26, 2008

(65) Prior Publication Data

US 2009/0065617 A1 Mar. 12, 2009

(30) Foreign Application Priority Data

Sep. 7, 2007 (JP) ..... 2007-232779

(51) Int. Cl.
*B02C 19/20* (2006.01)

(52) U.S. Cl. ..... 241/101.74; 241/99; 241/69

(58) Field of Classification Search ..... 241/99, 241/69, 79.1, 101.74, 101.741
See application file for complete search history.

(56) References Cited

U.S. PATENT DOCUMENTS

| | | | | |
|---|---|---|---|---|
| 4,852,815 | A * | 8/1989 | Giannotti | 241/65 |
| 5,938,132 | A * | 8/1999 | Shinjo et al. | 241/79.1 |
| 7,618,002 | B2 * | 11/2009 | Sato | 241/79.1 |

FOREIGN PATENT DOCUMENTS

| | | |
|---|---|---|
| DE | 3535633 | 4/1987 |
| EP | 0407679 | 1/1991 |
| JP | 8-26408 | 1/1996 |
| JP | 10-249857 | 9/1998 |
| JP | 10-250802 | 9/1998 |
| JP | 10-291603 | 11/1998 |
| JP | 11-20904 | 1/1999 |
| JP | 2003-182805 | 7/2003 |
| JP | 2007-167824 | 7/2007 |

* cited by examiner

*Primary Examiner* — Faye Francis
(74) *Attorney, Agent, or Firm* — Gerald E. Hespos; Michael J. Porco

(57) ABSTRACT

An auto vehicle capable of processing waste matter cuts pet bottles made of PET, which is a recyclable material, into chips while collecting the pet bottles, and an aligning portion configured to align the pet bottles fed therein via a loading portion, a processing portion configured to apply chipping to the pet bottles aligned by the aligning portion, and a chip storing portion configured to store chips formed by the processing portion, are provided on the deck. Waste matter can be thus automatically subjected to chipping without any involvement of manpower by merely loading collected waste matter into a collective hopper.

6 Claims, 7 Drawing Sheets

AUTO VEHICLE CAPABLE OF PROCESSING WASTE MATTER

BACKGROUND OF THE INVENTION

1. Field of the Invention

The present invention relates to an auto vehicle capable of processing waste matter configured to complete the processing to recycle collected waste matter up to a predetermined stage while it is running.

2. Description of the Related Art

Conventionally, waste matter, such as containers represented by a pet bottle disposed from homes and various sales stores, such as a convenience store and a supermarket store, is first collected by a waste matter collection vehicle and discharged at an intermediate processing station. The waste matter is subjected to compression processing and volume reduction processing, such as chipping. After the application of the volume reduction processing, the waste matter is generally transported from the intermediate processing station to the recycle factory, which is the final disposal station, and final disposal for recycle is applied to the volume-reduced waste matter.

The recycle system of container waste matter as described above, however, has a disadvantage that an investment of a large amount of money is required to construct the intermediate station. In order to overcome this disadvantage, Patent Documents 1 through 3 propose to apply the volume reduction processing to container waste matter collected by a waste matter collection vehicle, which is an auto vehicle, on the vehicle.

Patent Document 1 proposes a configuration to provide compressing means for applying compression processing to pet bottles and a baling means for baling the pet bottles compressed by the compressing means to the deck of the waste matter collection vehicle. The pet bottles after the compression processing are then delivered from the waste matter collection vehicle to the recycle factory in the form of bales.

On the contrary, Patent Documents 2 and 3 propose a configuration to feed pet bottles one by one to a shredder having rotary blades and provided at the back of the deck of the waste matter collection vehicle, so that the pet bottles are cut into chips after the labels are removed. The resulting chips are collected into a collection box mounted on the deck and the collection box is delivered to the recycle factory when it becomes full.

Hence, by using the waste matter collection vehicles described in Patent Documents 1 through 3 as a mobile factory, not only is it possible to provide extraordinary high mobility to the mobile factory, but it is also possible to eliminate the need to construct the intermediate processing station for applying the volume reduction processing to pet bottles. It thus becomes possible to obtain an extremely high degree of economic effect in terms of construction fees and constant expenses.

Patent Document 1: JP-A-10-291603

Patent Document 2: JP-A-10-249857

Patent Document 3: JP-A-10-250802

Incidentally, because the waste matter collection vehicle described in Patent Document 1 is merely to reduce the volume by compressing pet bottles, the pet bottles have to be cut into chips in the final factory in some cases. This proposal therefore has a problem that it is inadequate as the intermediate processing for container waste matter.

Also, with the waste matter collection vehicle described in Patent Documents 2 and 3, the worker has to manually insert pet bottles into the shredder provided at the rearmost of the deck one by one for subjecting pet bottles to shredding processing. These proposals therefore have a problem that the workability is poor.

SUMMARY OF THE INVENTION

The invention has an object to provide an auto vehicle which can process waste matter with ease.

According to an aspect of the invention, an auto vehicle capable of processing waste matter is adapted for applying a predetermined processing to waste matter made of a recyclable material while collecting the waste matter, and comprises an aligning portion configured to align loaded waste matter, a processing portion configured to apply chipping to the waste matter aligned by the aligning portion, and a chip storing portion configured to store chips formed by the processing portion.

DETAILED DESCRIPTION OF THE PREFERRED EMBODIMENTS OF THE INVENTION

Figure 1:
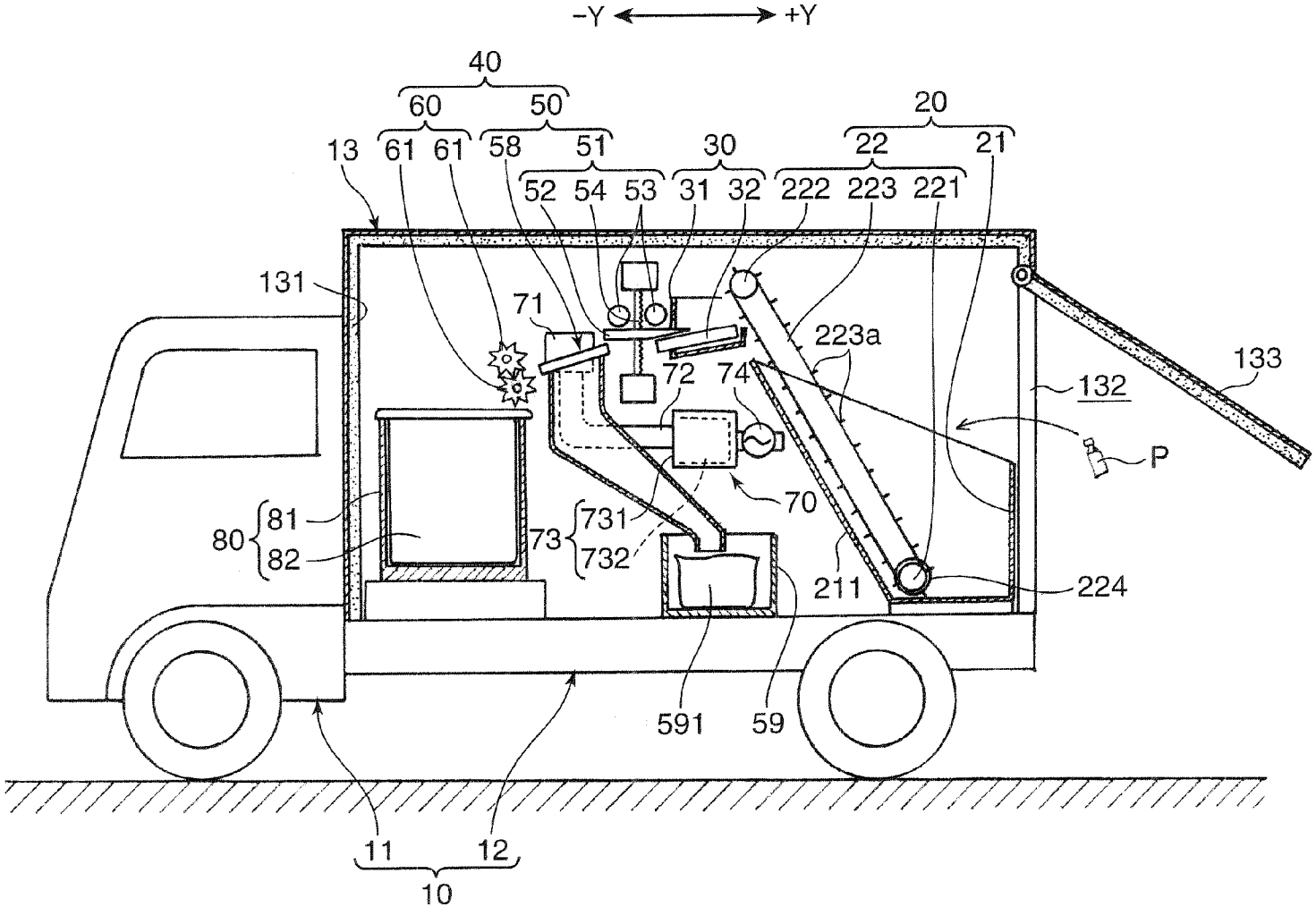
FIG. 1 is a schematic side view of a factory truck according to a first embodiment of the invention.
Figure 2:
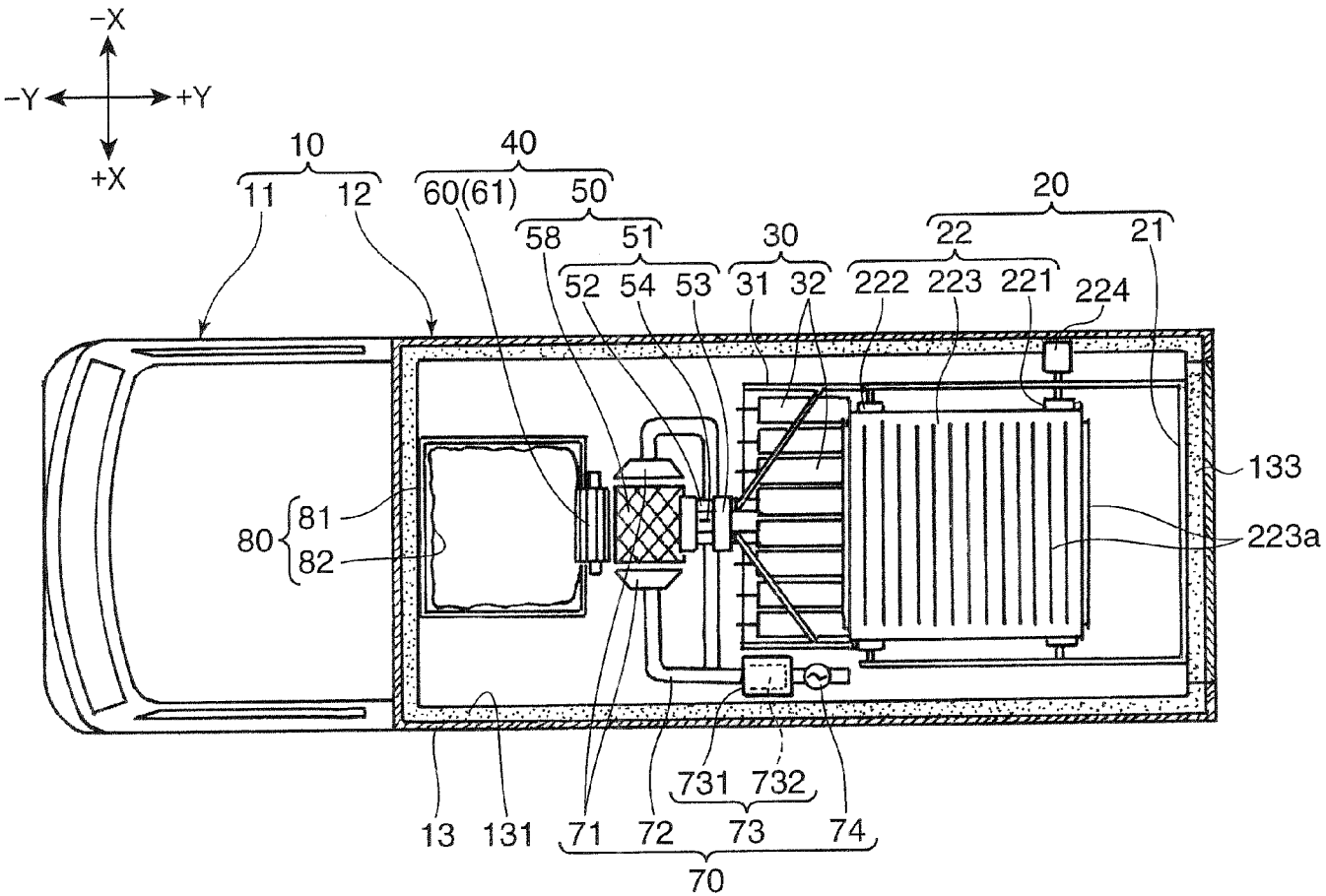
FIG. 2 is a schematic plan view of the factory truck shown in FIG. 1.

FIG. 1 is a schematic side view of a factory truck according to a first embodiment of the invention and FIG. 2 is a schematic plan view. In FIG. 1 and FIG. 2, the X-X direction is defined as the right-left direction and the Y-Y direction is defined as the front-rear direction. In particular, the −X direction is defined as leftward, the +X direction is defined as rightward, the −Y direction is defined as frontward, and the +Y direction is defined as rearward.

A factory truck (auto vehicle capable of processing waste matter) 10 of the first embodiment is to apply chipping to a subject, herein, a PET (polyethylene terephthalate) bottle P, which is a type of bottles made of synthetic resin as waste matter to be collected.

As is shown in FIG. 1 and FIG. 2, the factory truck 10 includes a cabin portion 11 having an engine, a driver's seat, and so forth, and a deck 12 connected to the rear portion of the cabin portion 11. To the deck 12 are provided a loading portion 20 that stores empty pet bottles P loaded therein, an aligning portion 30 that aligns pet bottles P pulled out from the loading portion 20, a processing portion 40 that successively applies chipping to pet bottles P aligned serially by the aligning portion 30, and a chip storing portion 80 that stores chips P3 obtained by the processing portion 40.

The loading portion 20, the aligning portion 30, and the chip storing portion 80 are covered with a covering body 13 in the shape of a square prism when viewed as a whole from the outer appearance. A soundproof material 131 made, for example, of a foaming synthetic resin, is applied to the covering body 13 on the inner surface side. It is therefore possible to prevent noises generated inside the covering body 13 from leaking to the outside.

A loading opening 132 through which pet bottles P are loaded and a openable and closable rear door 133 capable of closing the loading opening 132 are provided on the rear surface of the covering body 13 almost entirely. The rear door 133 is normally closed and it is opened as is shown in FIG. 1 when pet bottles P are loaded into the loading portion 20.

The loading portion 20 includes a loading hopper 21 installed at the rear end portion of the deck 12 and a belt conveyor 22 attached to the loading hopper 21. As is shown in FIG. 2, the loading hopper 21 is of a rectangular shape when viewed in a plane. The top-bottom dimension is set to about ½ of the top-bottom dimension of the covering body 13, and as is shown in FIG. 1, the front plate, which is one of components of the loading hopper 21, is an inclined plate 211 inclined to point upward (in this embodiment, inclined by about 60°).

The belt conveyor 22 includes a drive roller 221 provided in such a manner that the shaft center extends in the right-left direction immediately behind the inclined plate 211 inside the loading hopper 21, a driven roller 222 provided oppositely to the drive roller 221 at a position above and slightly ahead of the drive roller 221 so as not to interfere with the top plate of the covering body 13, and an endless belt 223 stretched between these drive roller 221 and the driven roller 222.

The drive roller 221 is configured to be driven to rotate in a counterclockwise direction by the driving of a first drive motor 224 (FIG. 2). Accordingly, the drive roller 221 is driven when the first drive motor 224 is driven, which causes the endless belt 223 stretched between the drive roller 221 and the driven roller 222 to circulate between the both rollers 221 and 222 in a counterclockwise direction.

A plurality of hooking protrusion pieces 223*a* are provided on the endless belt 223 lengthwise on the surface side at regular pitches. Accordingly, while the endless belt 223 is circulating in a counterclockwise direction, pet bottles P stored inside the loading hopper 21 are transported upward while being hooked by the hooking protrusion pieces 223*a* and fed into the aligning portion 30 when the endless belt 223 makes a turn at the position of the driven roller 222.

Figure 3:
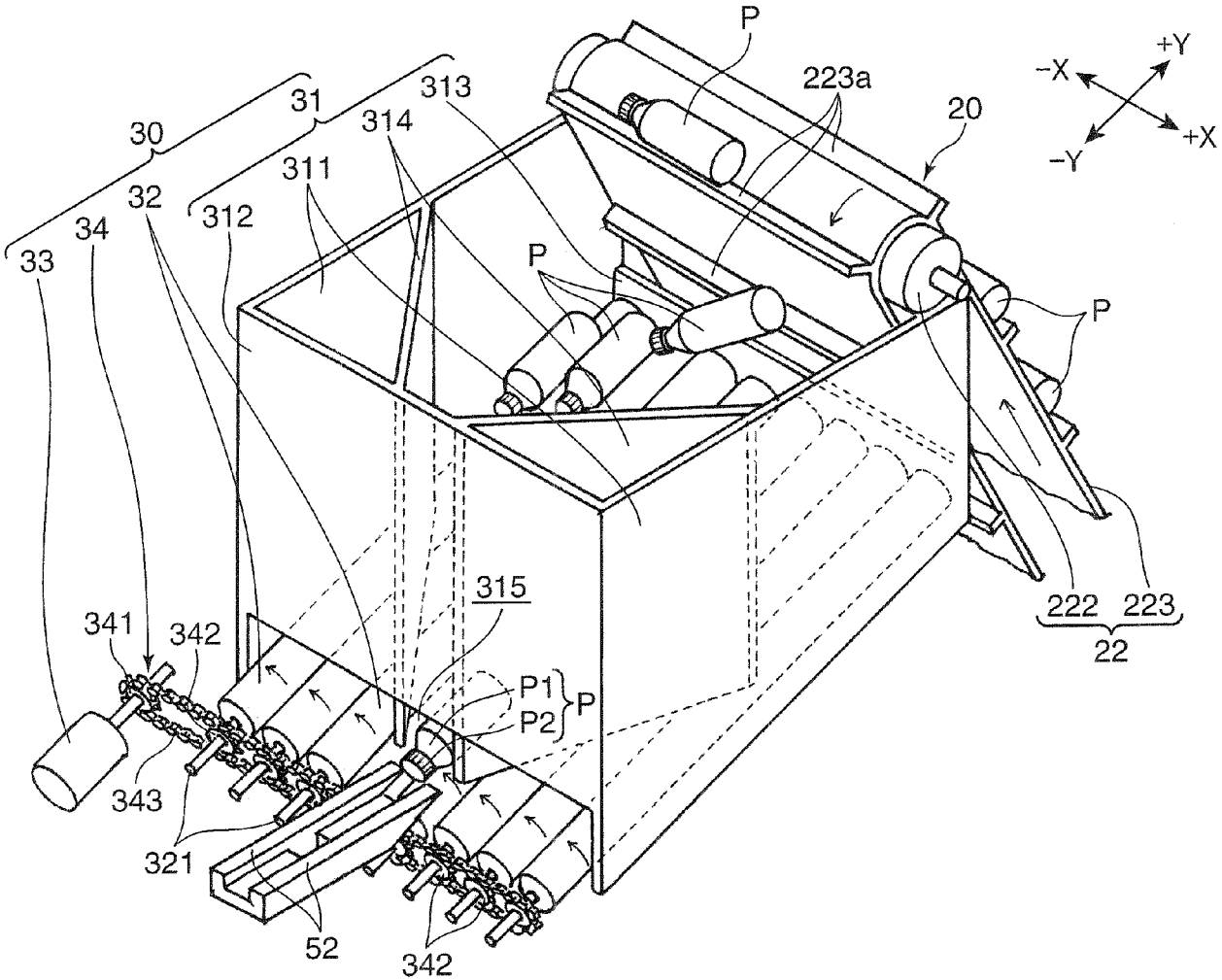
FIG. 3 is a perspective view of an aligning portion provided on the factory truck.

The aligning portion 30 is to serially align pet bottles P fed therein from the loading hopper 21 with circulations of the endless belt 223 to facilitate the processing thereafter. Hereinafter, the aligning portion 30 will be described on the basis of FIG. 3 and with reference to FIG. 1 and FIG. 2 when necessary. FIG. 3 is a perspective view showing one example of the aligning portion 30. The indication of direction using X and Y in FIG. 3 is the same as in FIG. 2 (X is the right-left direction (−X: leftward, +X: rightward), and Y is the front-rear direction (−Y: frontward, +Y: rearward)).

As is shown in FIG. 3, the aligning portion 30 includes an aligning hopper 31 that receives pet bottles P from the loading portion 20, a plurality of aligning rollers 32 that are laid at the bottom portion of the aligning hopper 31 so as to extend in the front-rear direction, a second drive motor 33 that rotates a plurality of the aligning rollers 32 simultaneously in the same direction about the shaft center, and a drive force transmission mechanism 34 that transmits a drive force of the second drive motor 33 to the respective aligning rollers 32.

The aligning hopper 31 includes a pair of side plates 311 paired in the right-left direction, a front plate 312 provided to bridge between the front edge portions of a pair of these side plates 311, a rear plate 313 provided to bridge between the rear edge portions of the respective side plates 311, and a pair of guide plates 314 paired in the right-left direction and provided to extend frontward from almost the center positions in the front-rear direction of the respective side plates 311 while gradually coming into close proximity to each other.

The rear plate 313 is set in such a manner that the top edge portion becomes slightly lower than the top edge portions of the side plates 311. The top end portion of the endless belt 223 is fit into this potion set lower. It is therefore configured in such a manner that pet bottles P carried by the endless belt 223 are delivered to the aligning hopper 31 in a reliable manner.

The front plate 312 is set in such a manner that the top edge portion is flush with the top edge portions of the side plates 311, whereas the bottom edge portion is spaced apart from the top surfaces of the aligning rollers 32 sufficiently for pet bottles P to pass through. The guide plates 314 are formed in such a manner that the top edge portions are flush with the top edge portions of the side plates 311 and the bottom edge portions almost come into sliding contact with the top edge portions of the aligning rollers 32. The front end edges of the respective guide plates 314 are spaced apart by a distance large enough for a pet bottle P oriented in the front-rear direction to pass through. Accordingly, a bottle passing opening 315 that allows only one pet bottle P oriented in the front-rear direction to pass through is formed at the front end position between the respective guide plates 314.

A plurality of the aligning rollers 32 are provided side by side between a pair of the side plates 311 and inclined to point downward to the front. Each aligning roller 32 has a roller shaft 321 penetrating through the inside and concentric with the center position in an integrally rotatable manner. Each roller shaft 321 penetrates through the aligning roller 32 in a state where it comes into sliding contact with an unillustrated frame at the front and the rear ends. This configuration allows each aligning roller 32 to integrally rotate about the roller shaft 321.

The second drive motor 33 is installed in a horizontally oriented posture to extend in the front-rear direction at a position at the front end of the aligning hopper 31 slightly outward from one side portion in the right-left direction. A drive force thereof is transmitted to the respective aligning rollers 32 via the drive force transmission mechanism 34.

The drive force transmission mechanism 34 includes a drive sprocket 341 fit outwardly to the drive shaft of the second drive motor 33 concentrically in an integrally rotatable manner, a plurality of driven sprockets 342 fit outwardly to the corresponding roller shafts 321 concentrically in an integrally rotatable manner, and a chain 343 put around the respective driven sprockets 342 and the drive sprocket 341.

According to the drive force transmission mechanism 34 as above, by driving the second drive motor 33, the drive force is transmitted to the respective driven sprockets 342 via the drive sprocket 341 and the chain 343. All the aligning rollers 32 thus rotate simultaneously in the same direction about their own roller shafts 321.

Pet bottles P transported into the aligning portion 30 from the loading portion 20 with circulations of the endless belt 223 by the driving of the first drive motor 224 are therefore guided by the rotations of the respective aligning rollers 32 in the same direction and thereby rotated in the opposite direction. The pet bottles P then slide down the aligning rollers 32 inclined to point downward to the front while the postures are being set to orient in the front-rear direction, and gathered in the center portion in the right-left direction by a pair of the guide plates 314. The pet bottles P are thus fed to the processing portion 40 one by one by passing through the bottle passing opening 315.

Referring to FIG. 1 and FIG. 2 again, the processing portion 40 includes a sorting portion 50 that sorts each pet bottle P fed from the aligning portion 30 to a bottle main body P1 and an accessory P2, and a shredder portion 60 that applies shredding processing to the bottle main body P1 sorted out by the sorting portion 50 to shred it into chips P3. The accessory P2 includes a mouth ring and a cap attached to the bottle main body P1, and further includes an annular label wrapped on the base of the bottle and so forth.

In general, these accessories P2 are often made of a synthetic resin material different from the bottle main bodies P1 made of PET (polyethylene terephthalate). When such a material is mixed into the chips P3 made of PET, it turns into an impurity during the recycle processing of the chip P3 and raises a problem in the recycle processing. The accessories P2 are sorted out by the sorting portion 50 in order to forestall such a problem.

Figure 4:
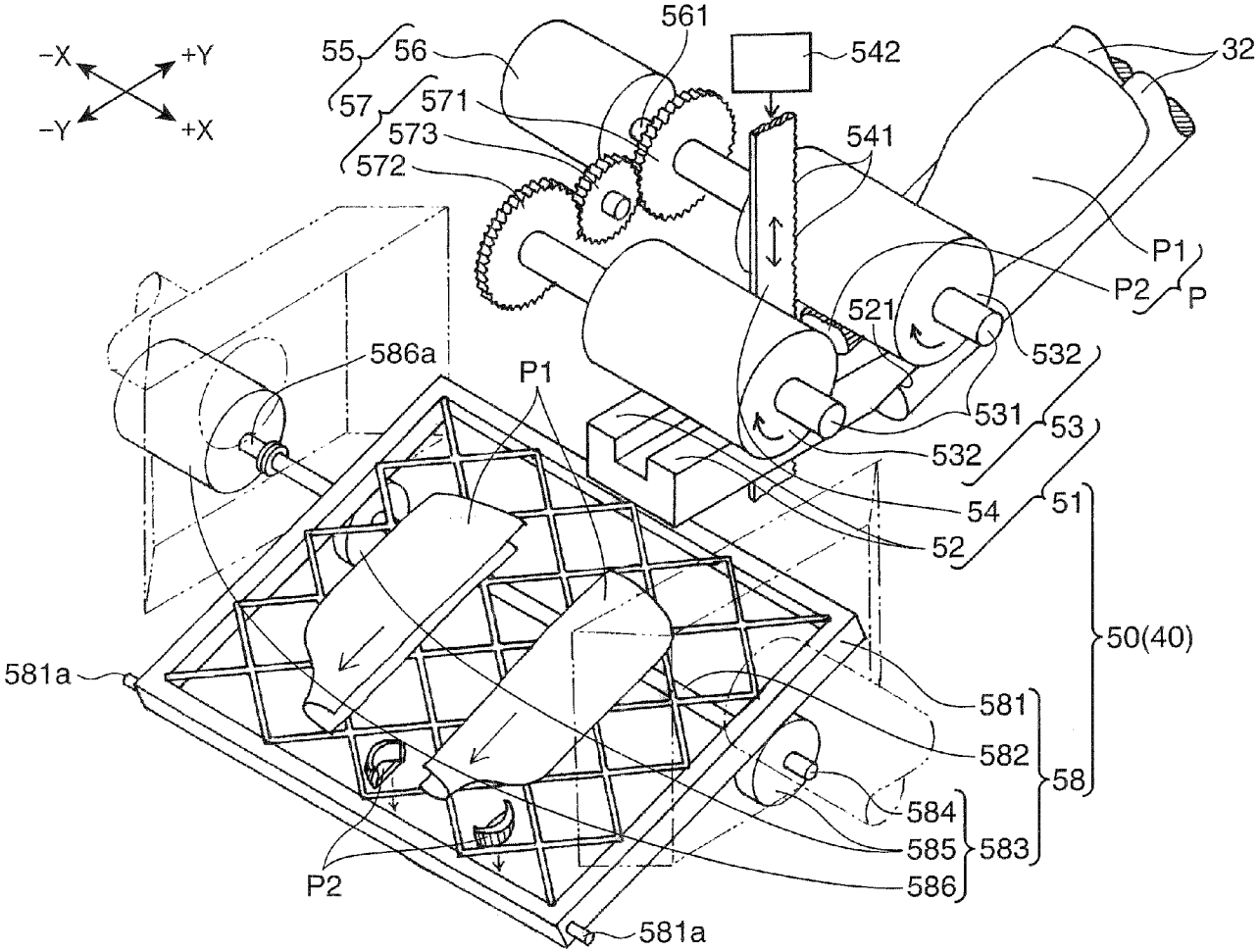
FIG. 4 is a perspective view of a sorting portion provided on the factory truck.

Hereinafter, the sorting portion 50 will be described on the basis of FIG. 4 and with reference to FIG. 1 through FIG. 3 when necessary. FIG. 4 is a perspective view showing the sorting portion 50. The indication of direction in FIG. 4 using X and Y is the same as in FIG. 3 (X is the right-left direction (−X: leftward, +X: rightward), and Y is the front-rear direction (−Y: frontward, +Y: rearward)). As is shown in FIG. 4, the sorting portion 50 includes a axial cutter device 51 that longitudinally cuts pet bottles P, and a sieve device (separation device) 58 that sifts broken pieces of the bottle main bodies P1 and broken pieces of the accessories P2 formed when pet bottles P are longitudinal cut by the axial cutter device 51.

The axial cutter device 51 includes a right-left pair of rail members 52 that receives a pet bottle P and moves it downstream by sliding contact, a front-rear pair of compression rollers 53 disposed oppositely to the top surfaces of a pair of these rail members 52 to compress the pet bottle P, a band saw 54 provided between a pair of the compression rollers 53 and also between a pair of the rail members 52 to extend in the top-bottom direction, and a rotation mechanism 55 that rotates a pair of the compression rollers 53.

Of all the aligning rollers 32, a pair of the rail members 52 is provided correspondingly to the two aligning rollers 32 at the center portion in the right-left direction, and a spaced distance between the rail members 52 is set to be shorter than the diameter dimension of the pet bottle P. Each rail member 52 is provided in such a manner that the top surface extends horizontally, and an inclination portion 521 inclined by the same inclination angle of the aligning rollers 32 is provided on the under surface of the rear end portion. The rail member 52 is therefore tapered off rearward.

The respective inclination portions 521 oppose the peripheral top surfaces of the corresponding aligning rollers 32 provided adjacently via a slight clearing. Accordingly, a pet bottle P sliding down while rotating about the center of the bottle between the aligning rollers 32 provided adjacently is scooped up by a pair of the rail members 52.

A pair of the compression rollers 53 applies compression processing to the pet bottle P scooped up by the rail members 52 in order to facilitate breaking processing and shredding processing on the pet bottle P thereafter. Each compression roller 53 includes a roller shaft 531 and a metal roller main body fit outwardly to the roller shaft 531 concentrically in an integrally rotatable manner. A distance between the respective compression rollers 53 is set to be long enough to accommodate the band saw 54.

A distance between the lower peripheral surface of each compression roller 53 and the top surfaces of the rail members 52 is set to be slightly larger than the thickness dimension of the pet bottle P when the base thereof is flatten out so as to leave a clearing.

The rotation mechanism 55 is formed of a third drive motor 56 that drives one roller shaft 531 (the rear roller shaft 531 in the case of FIG. 4) to rotate, and a gear mechanism 57 that transmits the drive rotation of one roller shaft 531 to the driven rotation of the other roller shaft 531. The drive shaft 561 of the third drive motor 56 is coupled to the rear roller shaft 531 concentrically in an integrally rotatable manner.

The gear mechanism 57 includes a drive gear 571 fit outwardly to the rear roller shaft 531 concentrically in an integrally rotatable manner, a driven gear 572 fit outwardly to the front roller shaft 531 concentrically in an integrally rotatable manner, and an idle gear 573 interposed between the driven gear 572 and the drive gear 571 so as to mesh with the both gears. Accordingly, when the drive shaft 561 is rotated in a clockwise direction by the driving of the third drive motor 56, the rotation is transmitted to the driven gear 572 via the drive gear 571 and the idle gear 573. The front and rear compression rollers 53 thus rotate in a clockwise direction about their own roller shafts 531.

The pet bottle P sliding down while rotating between the aligning rollers 32 provided adjacently is introduced into a space between a pair of the rotating compression rollers 53 and a pair of the rail members 52 and subjected to compression processing.

The band saw 54 is to longitudinally cut the pet bottle P lengthwise as it is forcedly moved frontward while it is subjected to compression processing by the compression roller 53 on the upstream side (the rearward side). The band saw 54 is attached in a space defined between a pair of the compression rollers 53 and between a pair of the rail members 52 of a rectangular shape when viewed in a plane in such a manner so as to extend in the top-bottom direction with the saw teeth 541 facing rearward. The band saw 54 is supported on an unillustrated frame in an up-and-down movable manner and an up and down movement providing mechanism 542 is provided on one end side.

Each pet bottle P introduced from the aligning rollers 32 into the compression roller 53 on the upstream side travels on the rail members 52 while being compressed by this compression roller 53, and subsequently, the pet bottle P together with the accessory P2 is longitudinally cut by the saw teeth 541 of the band saw 54 being moved up and down in a vibrating manner by the driving of the up and down movement providing mechanism 542 in succession. The pet bottle P cut into two pieces after the longitudinally cutting processing is further subjected to compression processing by the compression roller 53 on the downstream side, after which it is sent toward the sieve device (separation device) 58 in a state where the bottle main body P1 and the accessory P2 are broken into pieces.

The sieve device 58 is to separate the longitudinally cut pieces of the bottle main bodies P1 and the accessories P2 in a compressed state obtained by the axial cutter device 51 into the bottle main bodies P1 and the accessories P2, and provided with an inclination pointing downward to the front. The sieve device 58 includes a frame body 581 of a rectangular shape, a metal net 582 stretched across the frame body 581, and a vibration mechanism 583 that gives vibrations to the metal net 582.

Supporting shafts 581*a* are provided on the front end portion of the frame body 581 so as to protrude oppositely in the right-left direction. These supporting shafts 581*a* are supported on an unillustrated frame in a rotatable manner about the shaft center. This configuration allows the frame body 581 to oscillate about the supporting shafts 581*a*.

The dimension of the mesh of the metal net 582 is set in such a manner that the metal net 582 can sift out the accessories P2, such as mouth rings and caps, as the passing matter that is allowed to pass through the mesh and the broken bottle main bodies P1 as the remaining matter.

The vibration mechanism 583 includes a cam shaft 584 that transversely crosses the under surface of the frame body 581 in the right-left direction on the rear side in a sliding contact state, a pair of eccentric cams 585 paired in the right-left direction that is fit outwardly to the cam shaft 584 in an integrally rotatable manner, and a fourth drive motor 586 that rotates the cam shaft 584 about the shaft center. The drive shaft 586*a* of the fourth drive motor 586 is coupled to the cam shaft 584 concentrically in an integrally rotatable manner.

The respective eccentric cams 585 are fixed to the cam shaft 584 in the same phase and the respective peripheral surfaces abut on the frame body 581 on the back surface side of a right-left pair of longitudinal beams extending in the front-rear direction. Accordingly, when the cam shaft 584 is rotated about the shaft center by the driving of the fourth driving motor 586, the respective eccentric cams 585 rotate eccentrically. These eccentric rotations cause the metal net 582 to rotate about the supporting shafts 581*a* forward and backward in a vibrating manner. The broken accessories P2 fed to the sieve device 58 are sifted out in a reliable manner by passing through the mesh of the metal net 582 by the vibrations of the metal net 582.

Meanwhile, an accessory storing portion 59 (FIG. 1) to store the accessories P2, such as mouth rings and caps, sifted out by the sieve device 58 as the passing matter is provided at a position below the aligning portion 30. A flexible container bag 591 for accessory collection is attached to the accessory storing portion 59 in a state where the top surface is fully opened. The accessories P2 sifted out by the sieve device 58 are collected into the flexible container bag 591. When the flexible container bag 591 becomes full, it is unloaded from the accessory storing portion 59 with the opening in the top surface closed.

In this embodiment, a suction device 70 as is shown in FIG. 1, FIG. 2, FIG. 4, and FIG. 5 to collect light accessories P2', such as labels separated in the sieve device 58, is provided. The suction portion 70 includes suction hoods 71 provided on the frame body 581 of the sieve device 58 on the both side portions in the right-left direction, suction ducts 72 connected to the respective suction hoods 71, a collection portion 73 connected to the downstream ends of the suction ducts 72 to collect the light accessories P2', and a suction blower 74 connected to the downstream end of the collection portion 73.

The collection portion 73 has a casing 731 in the shape of a rectangular prism that is hollow inside, and a bag filter 732 attached to the casing 731 in a reattachable manner.

According to the suction device 70, a sheet of light accessory P2' wrapped on the bottle main body P1 is separated into pieces from the bottle main body P1 as the pet bottle P is longitudinally cut by the axial cutter device 51. Pieces of a sheet of light accessory P2' are sucked into the suction hoods 71 by an air flow developed by the driving of the induction blower 74 when these pieces move onto the metal net 582 of the sieve device 58 and trapped and collected in the bag filter 732 via the suction ducts 72.

Figure 5:
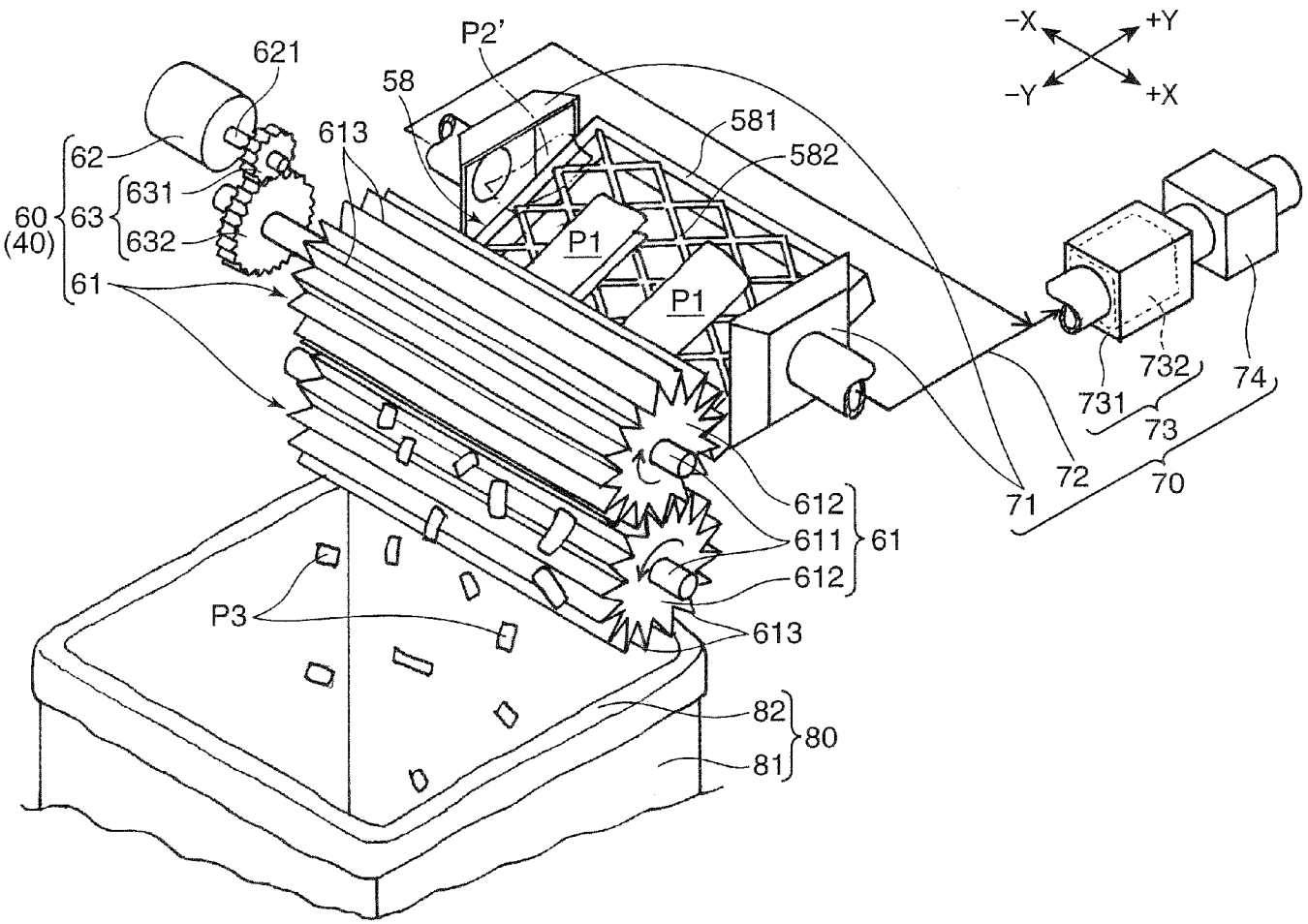
FIG. 5 is a perspective view of a shredder portion provided on the factory truck.

Referring to FIG. 1 and FIG. 2 again, the shredder portion 60 is to further apply shredding processing to the longitudinally cut pieces of the bottle main bodies P1 fed from the sieve device 58 as the remaining matter to form the chips P3, and it is provided directly downstream of the sieve device 58. Hereinafter, the shredder portion 60 will be described in detail on the basis of FIG. 5 and with reference to FIG. 1 through FIG. 4 when necessary. FIG. 5 is a perspective view showing the shredder portion 60. The indication of direction using X and Y in FIG. 5 is the same as in FIG. 2 (X is the right-left direction (−X: leftward, +X: rightward), and Y is the front-rear direction (−Y: frontward, +Y: rearward)).

As is shown in FIG. 5, the shredder portion 60 includes a top-bottom pair of shredder gears 61 meshed with each other, a fifth drive motor 62 to rotate a pair of these shredder gears 61, and a speed reduction gear 63 interposed between the fifth drive motor 62 and the shredder gears 61.

Each shredder gear 61 is formed of a gear shaft 611 and a gear main body 612 fit outwardly to the gear shaft 611 concentrically in an integrally rotatable manner. The gear main body 612 is provided with a plurality of gear teeth 613 at regular pitches in the circumferential direction. The tip end of each gear tooth 613 is formed sharp. The pet bottle main body P1 fed to the mesh position of the upper and lower shredder gears 61 after the breaking processing is shredded by the respective gear teeth 613 at the mesh position of the gear teeth 613. The chips P3 are thus formed.

The fifth drive motor 62 is installed in the vicinity of one shredder gear 61 (the upper shredder gear 61 in the case shown in FIG. 5) in a horizontally oriented posture so that the drive shaft 621 extends in the right-left direction. The speed reduction gear 63 is formed of a small diameter gear 631 fit outwardly to the drive shaft 621 concentrically in an integrally rotatable manner and a large diameter gear 632 fit outwardly to one gear shaft 611 (the upper one in the case of FIG. 5) concentrically in an integrally rotatable manner and meshed with the small diameter gear 631. Accordingly, the driving of the fifth drive motor 62 is transmitted to the upper gear shaft 611 via the drive shaft 621, the small diameter 631, and the large diameter gear 632 to rotate the upper shredder gear 61. The lower shredder gear 61 meshed with the upper shredder gear 61 thus rotates, too. The bottle main body P1 fed to the mesh position after the breaking processing is shredded as a pair of the shredder gears 61 rotate. The chips P3 are thus formed.

The chip storing portion 80 is provided directly downstream (front position) of the shredder portion 60. The chip storing portion 80 includes a chip storing vessel 81 in the shape of a rectangular prism with the top surface fully opened and a flexible container bag 82 for bottle main body attached to the chip storing vessel 81 in a state where the top surface is opened. The chips P3 formed by shredding the bottle main bodies P1 by the shredder portion 60 are collected into the flexible container bag 82.

As has been described in detail, the factory truck 10 of the first embodiment relates to a factory truck 10 as an auto vehicle capable of processing waste matter that cuts the pet bottles P made of PET, which is a recyclable material, into chips P3 while collecting the pet bottles P. The aligning portion 30 to align the pet bottles P successively fed therein via the loading portion 20, the processing portion 40 to apply chipping to the pet bottles P aligned by the aligning portion 30, and the chip storing portion 80 to store chips formed by the processing portion 40, are provided on the deck 12.

According to this configuration, the collected pet bottles P are aligned serially as they are successively loaded into the aligning portion 30 so that they are fed into the processing portion 40 in a state that facilitates the processing thereafter and shredded into chips as they are subjected to the shredding processing. The chips thus obtained are stored in the chip storing portion 80.

In this manner, it is configured in such a manner that the aligning portion 30 to align the pet bottles P is provided on the deck 12 of the auto vehicle so that chipping is applied successively to the pet bottles P in an aligned state. This configuration eliminates the need for a tedious work to manually feed pet bottles P collected by the worker to the shredder one by one to shred them into chips as in the conventional manner. Consequently, it becomes possible to markedly enhance the workability in chipping of the pet bottles P using an auto vehicle, which can increase the efficiency significantly in chipping of the pet bottles P.

The processing portion 40 includes the sorting portion 50 that breaks pet bottles P aligned by the aligning portion 30 to sort the bottle main bodies P1 as the target matter and the accessories P2, such as mouth rings and caps, the shredder portion 60 that applies the shredding processing to the target matter sorted out by the sorting portion 50 and shreds the targeted matter into chips, and the accessory storing portion 59 that stores the accessories P2 sorted out by the sorting portion 50.

The collected pet bottles P are therefore aligned by the aligning portion 30 and introduced into the sorting portion 50 in a state that facilitates the processing thereafter. The pet bottles P introduced into the sorting portion 50 are broken into pieces, which are sorted to broken pieces of the bottle main bodies P1 as the target matter and the accessories P2, such as mouth rings and caps. Subsequently, the bottle main bodies P1 are shredded into chips by the shredding processing in the shredding portion 60 and stored in the chip storing portion 80, whereas the sorted accessories P2 are stored in the accessory storing portion 59.

In this manner, it is configured in such a manner that the pet bottles P are broken and the accessories P2, such as mouth rings, are removed from the bottle main bodies P1 in the sorting portion 50. It is therefore possible to effectively prevent the occurrence of an inconvenience that the accessories P2, such as mouth rings, made of a different material are mixed into the chips of the bottle main bodies P1.

The sorting portion 50 includes the axial cutter device 51 that longitudinally cuts each pet bottle P at least into two pieces and the sieve device 58 as a separation device that separates the longitudinal cut pieces longitudinally cut by the axial cutter device 51 to the bottle main bodies P1 and the accessories P2. Accordingly, each pet bottle P together with the accessory P2, such as a mouth ring, is longitudinally cut at least into two pieces by the axial cutter device 51. Hence, even when the accessory P2, such as a mouth ring, is threaded into the bottle main body P1 and screwed shut, the accessory P2 can be removed easily from the bottle main body P1.

The sieve device 58 that collects the bottle main bodies P1 as the remaining matter and collects the accessories P2 as the passing matter is adopted as the sieve device. Accordingly, by feeding the pet bottles P longitudinally cut by the axial cutter device 51 to the sieve device 58, the bottle main bodies P1 formed by the longitudinally cutting processing are collected as the remaining matter whereas the accessories P2, such as mouth rings having a small volume, are sifted out as the passing matter. By adopting the sieve device 58 as the separation device in this manner, it becomes possible to separate the bottle main bodies P1 and the accessories P2 in a reliable manner while making the structure of the separation device simpler.

The sieve device 58 has the suction device 70 that removes the light accessories P2', such as labels wrapped on the pet bottles P, by suction with an air flow while the bottle main bodies P1 are passing through the sieve device 58. Hence, in a case where the labels are wrapped on the pet bottles P, the light accessories P2' are also broken by the breaking processing of the pet bottles P and thereby separated from the bottle main bodies P1. The light accessories P2' thus separated are removed as they are sucked into the suction device 70 with an air flow. By providing the suction device 70 to provide the capability of sucking the light accessories P2' in this manner, even when the light accessories P2' are wrapped on the bottle main bodies P1, the light accessories P2' are removed from the bottle main bodies P1. It thus becomes possible to prevent the occurrence of an inconvenience that the light accessories P2' made of a different material are mixed into the bottle main bodies P1.

The shredder portion 60 includes a pair of the shredder gears 61 configured to mesh with each other so that the bottle main bodies P1 are fed to the mutually meshed portion. The broken bottle main bodies P1 are introduced into the mesh position of the shredder gears 61 rotating while being meshed with each other and continuously shredded into chips in succession. Hence, in comparison with a case where a cutter device adopting a reciprocating way is used, it is possible to markedly enhance efficiency of the shredding processing.

Figure 6:
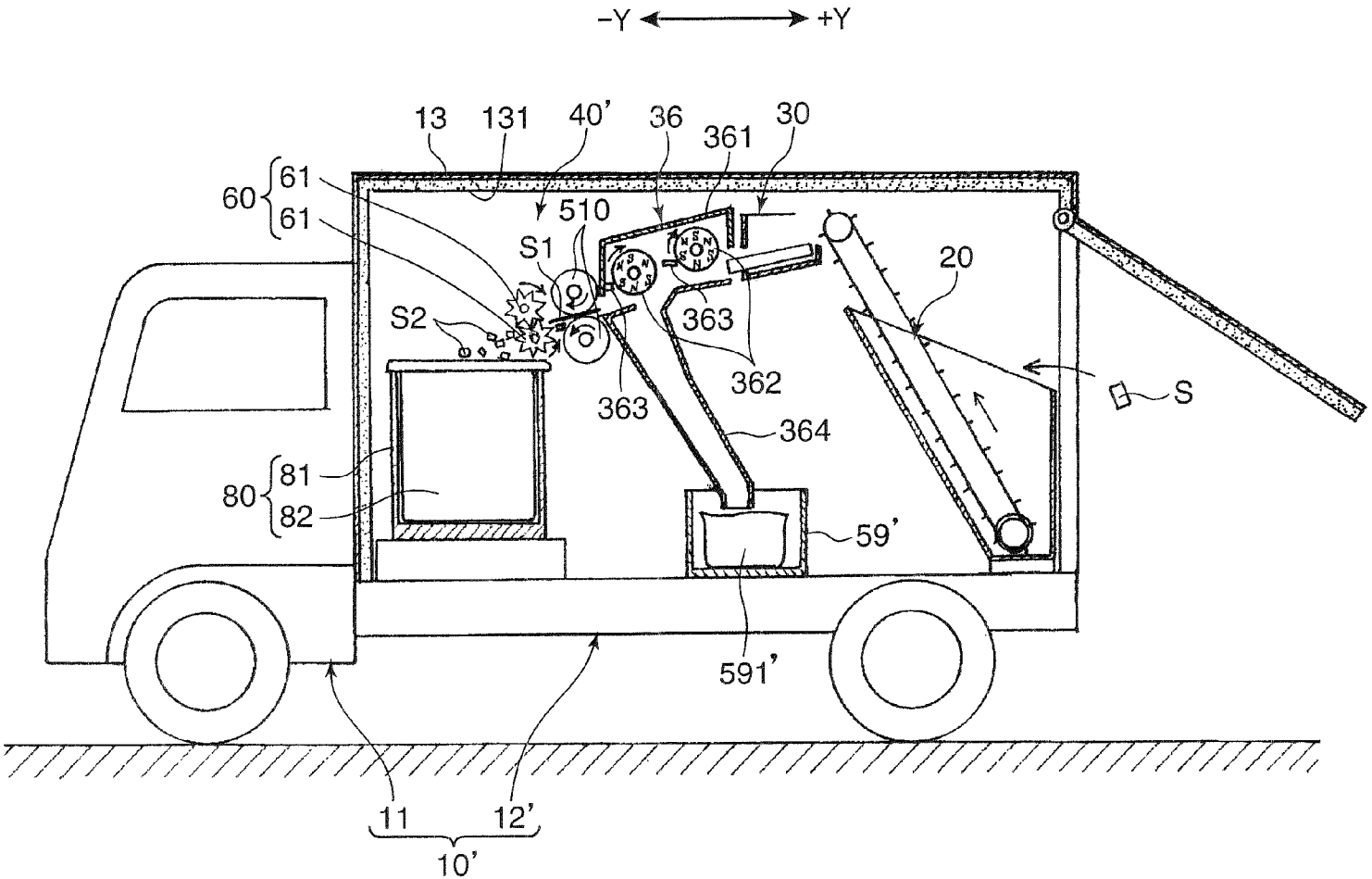
FIG. 6 is a schematic side view of a factory truck according to a second embodiment of the invention.

FIG. 6 is a schematic side view of a factory truck according to a second embodiment of the invention. The indication of direction using Y in FIG. 6 is the same as in FIG. 1 (−Y: frontward, +Y: rearward). In the second embodiment, a factory truck (auto vehicle capable of processing waste matter) 10' is to apply chipping to so-called steel cans S made of iron or iron alloy by selecting the steel cans S as the subject.

As is shown in FIG. 6, the aligning portion 30 provided on a deck 12' of the factory truck 10' has a selection device 36 provided at the downstream end to select steel cans S from aligned cans using a magnetic force.

The selection device 36 includes a housing 361 inclined to point downward to the front from the downstream end of the aligning portion 30, a pair of magnet drums 362 paired in the front-rear direction and enclosed in the housing 36, a front-rear pair of blades 363 provided so that the tip edge portions abut on the peripheral surfaces of the corresponding magnet drums 362 at the front positions.

A pair of the magnets 362 is set in such a manner that the one in the front is slightly lower than the one in the rear. A plurality of permanent magnets are attached to each magnet drum 362 all along the inner peripheral surface at regular pitches. Accordingly, when the magnet drums 362 are rotated in a counterclockwise direction about the drum center by the driving of an unillustrated drive motor, each time a can is delivered to the selection device 36 from the aligning portion 30, in a case where this can is a steel can S, the steel can S is attracted to the peripheral surface of the magnet drum 362 by the action of the magnets.

The steel can S attracted to the peripheral surface of the magnet drum 362 is then forced off by the blade 363 as the magnet drum 362 rotates and attracted to the magnet drum 362 on the downstream side, after which it is again forced off by the blade 363 and fed to compression rollers 510 described below.

A steel can S that the magnet drum 362 on the upstream side failed to attract is therefore attracted by the magnet drum 362 on the downstream side. In this manner, by providing the magnet drums 362 in two stages, it becomes possible to pick up steel cans S in a more reliable manner.

Meanwhile, in a case where a can from the aligning portion 30 is not a steel can S, this can is attracted to neither of the magnet drums 362 and falls down from an introduction hole provided on an appropriate point in the bottom plate of the housing 361 and collected into a flexible container bag 591' for non-ferrous can collection attached to a non-ferrous can storing portion 59' through a chute 364.

A top-bottom pair of compression rollers (compression roller pair) 510 having a diameter dimension considerably larger than the diameter dimension of steel cans S is provided downstream of the selection device 36 instead of the axial cutter device 51. In the second embodiment, a processing portion 40' includes the selection device 36, the compression rollers 510, and the shredder portion 60.

The compression rollers 510 in a pair are axially supported by their own roller shafts 511 extending in the right-left direction (a direction perpendicular to the sheet surface of FIG. 6) in a rotatable manner in opposite directions (the upper compression roller 510 rotates in a clockwise direction and the lower compression roller 510 rotates in a counterclockwise direction) by the driving of an unillustrated motor.

Accordingly, steel cans S introduced downstream from the selection device 36 are pulled in a space between a top-bottom pair of the compression rollers 510 rotating in opposite directions and flattened by the compression processing. Flattened steel cans S1 formed by the compression processing are introduced into the shredder portion 60 configured in the same manner as the counterpart of the first embodiment and chips S2 are formed therein. The chips S2 thus obtained are collected into a flexile container bag 82 inside a chip storing vessel 81 provided on a chip storing portion 80 same as the counterpart of the first embodiment.

According to the factory truck 10' of the second embodiment, of the metal cans, only the steel cans S collected by the action of electromagnets of the selection device 36 are fed into the compression rollers 510 and subjected to the compression processing, after which the steel cans S are subjected to shredding processing and shredded into the chips S2 in the shredder portion 60. Hence, chipping can be applied automatically to the steel cans S alone without having to make a selection as to whether collected cans are steel cans S or aluminum cans. It thus becomes possible to make intermediate processing to recycle cans more efficient.

It should be appreciated that the invention is not limited to the embodiments above and it is understood that the invention includes the following contents.

(1) In the embodiments above, pet bottles P or steel cans S are first loaded into the loading portion 20 of the factory truck 10 or 10'. However, it may be configured in such a manner that pet bottles P or steel cans S are directly loaded into the aligning portion 30 without providing the loading portion 20.

(2) In the factory truck 10 of the first embodiment above, pet bottles P are fed one by one from the aligning portion 30 to the axial cutter device 51 on the downstream side. However, instead of this configuration, it may be configured in such a manner that more than one pair of the rail members 52 is provided, so that a plurality of pet bottles P are subjected to the breaking processing by the band saws 54 simultaneously.

(3) In the first embodiment above, the band saw 54 is adopted to longitudinally cut the pet bottles P. However, it may be configured in such a manner that pet bottles P are broken by press processing instead of using the band saw 54.

(4) In the first embodiment above, the description was given using PET containers as an example of waste matter subjected to chipping. In the invention, however, waste matter is not limited to those made of PET and a material subjected to chipping may be waste matter made of synthetic resin of another type.

Figure 7:
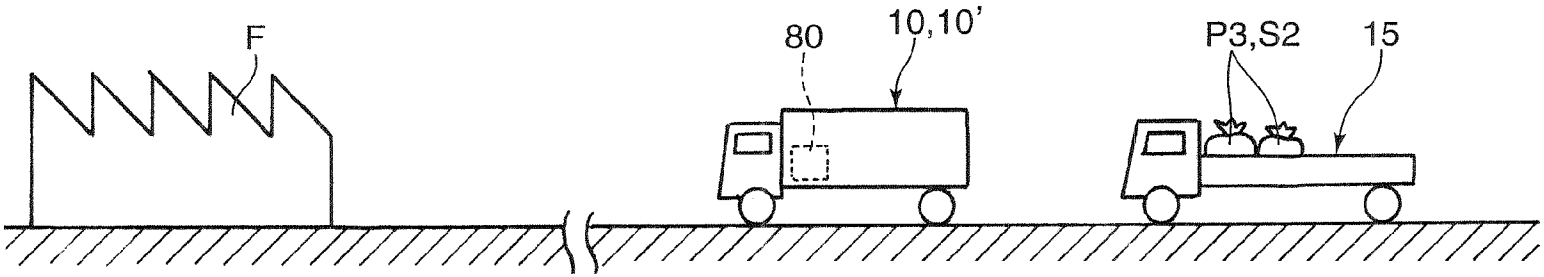
FIG. 7 is a schematic view showing a state where a shuttle truck is run to accompany the factory truck.

(5) In order to apply chipping to container waste matter efficiently using the factory truck 10 or 10' of the above embodiments, as is shown in FIG. 7, it may be preferable to run a shuttle truck 15 used exclusively to store the chips P3 or S2 to accompany the factory truck 10 or 10'. This is because the capacity of the chip storing portion 80 of the factory truck 10 or 10' cannot be increased significantly, and it is quite inefficient for the factory truck 10 or 10' to return to the recycle factory F each time the chip storing portion 80 becomes full.

By running the shuttle truck 15 to accompany the factor truck 10 or 10', the chips P3 or S2 are discharged from the chip storing portion 80 of the factory truck 10 or 10' each time the chip storing portion 80 of the factory truck 10 or 10' becomes full and transferred to the deck of the shuttle truck 15 on site. The need for the factory truck 10 or 10' to return to the recycle factory F in each occasion can be thus eliminated, which can in turn enhance the chipping efficiency of the factory truck 10 or 10'.

The shuttle truck 15 transports the chips P3 or S2 to the recycle factory F when it becomes full of the chips P3 or S2. In other words, each time the deck becomes full of the chips P3 or S2, the shuttle truck 15 shuttles between the factory truck 10 or 10' and the recycle factory F.

Technical characteristics of the embodiments above are summarized as follows.

The auto vehicle described above is an auto vehicle capable of processing waste matter that applies a predetermined processing to waste matter made of a recyclable material while collecting the waste matter, and includes: an aligning portion configured to align loaded waste matter; a processing portion configured to apply chipping to the waste matter aligned by the aligning portion; and a chip storing portion configured to store chips formed by the processing portion.

According to the auto vehicle capable of processing waste matter described above, collected water matter is aligned serially when loaded into the aligning portion and fed into the processing portion in this state and shredded. This configuration eliminates the need for a tedious work to manually feed waste matter collected by the worker to the shredder one by one to shred the waste matter into chips as in the conventional manner. Consequently, it becomes possible to markedly enhance the workability in chipping of waste matter using an auto vehicle.

It may be preferable that the waste matter is a bottle made of synthetic resin, and that the processing portion includes a sorting portion configured to break the bottle aligned by the aligning portion and to sort broken pieces of the bottle to targeted matter to be collected and an accessory, a shredder portion configured to shred the target matter sorted by the sorting portion into the chips by applying shredding processing, and an accessory storing portion configured to store the accessory sorted by the sorting portion.

According to this configuration, collected bottles made of synthetic resin are aligned by the aligning portion and introduced into the sorting portion in a state that facilitates the processing thereafter. The bottles introduced into the sorting portion are broken into pieces, which are sorted to broken pieces of the bottle main bodies, which are targeted matter to be collected, and accessories, such as mouth rings. The target matter is subsequently shredded into chips by the shredding processing in the shredder portion and stored into the chip storing portion. Meanwhile, the sorted accessories are stored into the accessory storing portion.

As has been described, the bottles are broken by the sorting portion and the accessories, such as mouth rings, are removed from the bottle main bodies. It thus becomes possible to effectively prevent the occurrence of an inconvenience that the accessories, such as mouth rings, made of a different material are mixed into the chips of the bottle main bodies.

It may be preferable that the sorting portion includes an axial cutter device configured to longitudinally cut the bottle at least into two pieces, and a separation device configured to separate cut pieces longitudinally cut by the axial cutter device to the target matter and the accessory.

According to this configuration, because the bottles together with the accessories, such as mouth rings, are longitudinally cut into at least two pieces by the axial cutter device, for example, even when the accessories, such as mouth rings, are threaded into the bottle main bodies and screwed shut, the accessories can be readily removed from the bottle main bodies. The accessories thus removed are separated from the bottle main bodies by the separation device.

It may be preferable that the separation device includes a sieve device configured to collect the target matter as remaining matter and collect the accessory as passing matter.

According to this configuration, by feeding the bottles in a state longitudinally cut by the axial cutter device to the sieve device, the target matter on the bottle main body side formed by the longitudinally cutting processing are collected as the remaining matter whereas the accessories, such as mouth rings having a small volume, are sifted out as the passing matter. In this manner, by adopting the sieve device as the separation device, it becomes possible to achieve separation processing of the target matter and the accessories in a reliable manner while making the structure of the separation device simpler.

It may be preferable that the separation device has a suction device configured to remove a label wrapped on the bottle by suction.

According to this configuration, in a case where labels are wrapped on the bottles, the labels are also broken and separated from the bottles by the breaking processing of the bottles. The separated labels are removed as they are sucked into the sucking device with an air flow. In this manner, by providing the sucking device to provide the capability of sucking the labels, even when the labels are wrapped on the bottle main bodies, the labels are removed from the bottom main bodies. It thus becomes possible to prevent the occurrence of an inconvenience that labels made of a different material are mixed into the target matter.

It may be preferable that the shredder portion is provided with a shredder gear pair configured in such a manner that the target matter is fed into a mutually meshed portion.

According to this configuration, the broken targeted matter to be collected is introduced into the mesh position of the shredding gear pair rotating while being meshed with each other and continuously shredded into chips in succession. Hence, in comparison with a case where a cutter device adopting a reciprocating way is used, it is possible to markedly enhance efficiency of the shredding processing.

It may be preferable that: the waste matter is a can made of magnetic metal, such as iron or iron alloy; the aligning portion has a selection device configured to select cans made of magnetic metal among aligned cans using a magnetic force; and the processing portion has a compression portion configured to apply compression processing successively to selected cans, and a shredder portion configured to shred the cans compressed by the compression portion into chips by applying shredding processing.

According to this configuration, collected cans made of magnetic metal, such as iron or iron alloy, are introduced into the selecting device one by one after they are aligned by the aligning portion, and cans made of magnetic metal are selected by applying selection processing using a magnetic force. The cans made of magnetic metal thus selected are subjected to compression processing in the compressing portion. The cans made of magnetic metal after the compression processing are subsequently shredded into chips by the shredding processing in the shredder portion and the chips are stored into the chip storing portion.

As has been described, with the aim of recycling, cans made of magnetic metal are selected by the selecting device using a magnetic force and shredded into chips after the compression processing is applied. It thus becomes possible to effectively prevent the occurrence of an inconvenience that a material other than magnetic metal, such as aluminum, is mixed into the chips.

It may be preferable that the compression portion is provided with a compression roller pair configured in such a manner that the cans are fed to a portion where peripheral surfaces oppose each other.

According to this configuration, the compression processing can be applied to the cans by merely feeding the cans to the opposing portion of the peripheral surfaces of the compression roller pair rotating in the opposite directions. Accordingly, in comparison with a type that applies compression processing to cans using, for example, a reciprocating way, the structure of the compressing portion can be simpler.

It may be preferable that the processing portion is provided with a vibration providing mechanism configured to provide vibrations to the waste matter.

According to this configuration, vibrations are provided on the waste matter in the processing portion by the vibration providing mechanism. It thus becomes possible to apply the respective types of processing to the waste matter in the processing portion efficiently and in a reliable manner by these vibrations.

This application is based on Japanese Patent application No. 2007-232779 filed in Japan on Sep. 7, 2007, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. An auto vehicle provided with a processor which collects waste bottles, each waste bottle having a bottle main portion made of synthetic resin and a cap, the processor processes the collected waste bottles into a usable material, the processor comprising:

an aligning portion for aligning a loaded waste bottle;

a processing portion for chipping the waste bottle aligned by the aligning portion, the processing portion including:

a sorting portion having:

an axial cutter device for longitudinally cutting the waste bottle into two pieces or more; and a separation device for separating the cut pieces longitudinally cut by the axial cutter device to a desirable material as a target matter and an undesirable material as an accessory;

a shredder portion for shredding the target matter sorted by the sorting portion into chips, and an accessory storing portion for storing the accessory sorted by the sorting portion a chip storing portion configured to store chips formed by the processing portion.

2. The auto vehicle according to claim 1, wherein:

the separation device includes a sieve device for collecting the target matter and collect the accessory.

3. The auto vehicle according to claim 1, wherein:

the separation device has a suction device for removing a label wrapped on the waste bottle by suction.

4. The auto vehicle according to claim 1, wherein:

the shredder portion is provided with a pair of shredders for shredding the target matter.

5. The auto vehicle capable according to claim 1, wherein:

the processing portion is provided with a vibration providing mechanism for vibrating the waste matter.

6. The auto vehicle according to claim 1, wherein the aligning portion includes:

an aligning hopper for receiving the waste bottle;

a plurality of aligning rollers that are laid side by side on a bottom of the aligning hopper, respective axis of the plurality of aligning rollers extending in a direction of advancing toward the processing portion, and inclining downward in such a way that their respective downstream ends lie at a lower position than their respective upstream ends;

a driver that rotates the plurality of aligning rollers simultaneously in the same direction; and a pair of guide plates provided in the aligning hopper and spaced apart from each other in a transverse direction, the downstream ends of the pair of guide plates being closer to each other than the upstream ends, the downstream ends of the pair of guide plates being spaced apart from each other at such a distance as to pass only one waste bottle.

* * * * *